US008092358B2

(12) United States Patent
Kuruma et al.

(10) Patent No.: US 8,092,358 B2
(45) Date of Patent: Jan. 10, 2012

(54) CHARGING MEMBER, PROCESS CARTRIDGE AND ELECTROPHOTOGRAPHIC APPARATUS

(75) Inventors: Yoko Kuruma, Mishima (JP); Noriaki Kuroda, Suntou-gun (JP); Noriko Nagamine, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/080,594

(22) Filed: Apr. 5, 2011

(65) Prior Publication Data

US 2011/0182617 A1 Jul. 28, 2011

Related U.S. Application Data

(63) Continuation of application No. PCT/JP2010/007136, filed on Dec. 8, 2010.

(30) Foreign Application Priority Data

Dec. 14, 2009 (JP) ..... 2009-282694

(51) Int. Cl.
*G03G 21/18* (2006.01)

(52) U.S. Cl. ..... 492/53; 492/54; 492/18; 492/25

(58) Field of Classification Search ..... 492/53, 492/54, 17, 18, 24, 25
See application file for complete search history.

(56) References Cited

U.S. PATENT DOCUMENTS

| | | | | |
|---|---|---|---|---|
| 6,168,867 | B1 * | 1/2001 | Davis et al. | 428/450 |
| 7,524,917 | B2 | 4/2009 | Ootake et al. | |
| 7,693,457 | B2 | 4/2010 | Kuruma et al. | |
| 7,962,068 | B2 | 6/2011 | Kuroda et al. | |
| 2008/0171846 | A1 | 7/2008 | Ootake et al. | |
| 2009/0067880 | A1 | 3/2009 | Kuroda et al. | |
| 2010/0137540 | A1 | 6/2010 | Ito et al. | |
| 2010/0226684 | A1 | 9/2010 | Mayuzumi et al. | |

FOREIGN PATENT DOCUMENTS

| | | | |
|---|---|---|---|
| JP | 2001-173641 | A | 6/2001 |
| JP | 2003-119288 | A | 4/2003 |
| JP | 2007-332211 | A | 12/2007 |
| JP | 2008-150478 | A | 7/2008 |
| WO | 2005/000857 | A1 | 1/2005 |
| WO | WO 2006070847 | A1 * | 7/2006 |
| WO | 2008/123122 | A1 | 10/2008 |

OTHER PUBLICATIONS

Kuroda, et al., U.S. Appl. No. 13/106,632, filed May 12, 2011.
Kuruma, et al., U.S. Appl. No. 13/080,610, filed Apr. 5, 2011.
PCT International Search Report and Written Opinion of the International Searching Authority, International Application No. PCT/JP2010/007136, Mailing Date Jan. 25, 2011.
PCT International Search Report, International Application No. PCT/JP2010/007136, Mailing Date Jan. 25, 2011.

* cited by examiner

*Primary Examiner* — David Bryant
*Assistant Examiner* — Christopher Besler
(74) *Attorney, Agent, or Firm* — Fitzpatrick, Cella, Harper & Scinto

(57) ABSTRACT

The present invention provides a charging member which can maintain excellent wear resistance even though being used repeatedly. In the charging member having a surface layer, the surface layer is a surface layer constituted by at least one selected from silsesquioxanes having structures represented by a compound (1), a compound (2), a compound (3), a compound (4), a compound (5) and a compound (6), and a polysiloxane having a first unit represented by $SiO_{0.5}R^1(OR^2)(OR^3)$, a second unit represented by $SiO_{1.0}R^4(OR^5)$ and a third unit represented by $SiO_{1.5}R^6$, wherein the silsesquioxane is contained in the polysiloxane.

5 Claims, 1 Drawing Sheet

CHARGING MEMBER, PROCESS CARTRIDGE AND ELECTROPHOTOGRAPHIC APPARATUS

CROSS-REFERENCE TO RELATED APPLICATIONS

This application is a continuation of International Application No. PCT/JP2010/007136, filed Dec. 8, 2010, which claims the benefit of Japanese Patent Application No. 2009-282694, filed Dec. 14, 2009.

BACKGROUND OF THE INVENTION

1. Field of the Invention

The present invention relates to a charging member which is used in an electrophotographic apparatus, a process cartridge, and the electrophotographic apparatus.

2. Description of the Related Art

In an electrophotographic apparatus, a charging member (hereinafter also referred to as a "charging roller") which comes into contact with the surface of an electrophotographic photosensitive member and has a roller shape for charging the surface of the electrophotographic photosensitive member generally has an elastic layer containing a resin. Such a charging roller can sufficiently secure a nip width between the charging roller and the electrophotographic photosensitive member, and as a result, can efficiently and uniformly charge the electrophotographic photosensitive member. However, the elastic layer contains a low-molecular-weight component of a plasticizer or a resin, so as to be softened. Therefore, the low-molecular-weight component may bleed to the surface of the charging roller after long-term use. With respect to such a problem, Japanese Patent Application Laid-Open No. 2001-173641 discloses a conductive roll substrate which covers the surface of the charging roller with a bleeding block layer consisting of an inorganic oxide film formed by a sol-gel method, and suppresses the bleeding of the low-molecular-weight component up to the surface.

SUMMARY OF THE INVENTION

According to an investigation by the present inventors, it was found that the conductive roll disclosed in Japanese Patent Application Laid-Open No. 2001-173641, of which the bleeding block layer is the surface layer, is gradually worn after repeated use, and the charging performance results in changing with time.

Then, the present invention is directed to provide a charging member of which the charging performance less changes with time even after long-term use.

Further, the present invention is directed to provide a process cartridge and an electrophotographic apparatus which can stably form a high-quality electrophotographic image.

According to one aspect of the present invention, there is provided a charging member comprising a support, an electroconductive elastic layer and a surface layer in this order, wherein said surface layer contains polysiloxane and silsesquioxane, wherein said polysiloxane has a first unit represented by $SiO_{0.5}R^1(OR^2)(OR^3)$, a second unit represented by $SiO_{1.0}R^4(OR^5)$ and a third unit represented by $SiO_{1.5}R^6$, and said silsesquioxane is at least one compound selected from the group consisting of compounds represented by the following compounds (1) to (6):

Compound (1)

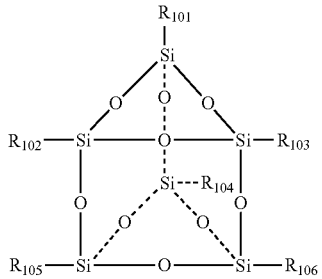

Compound (2)

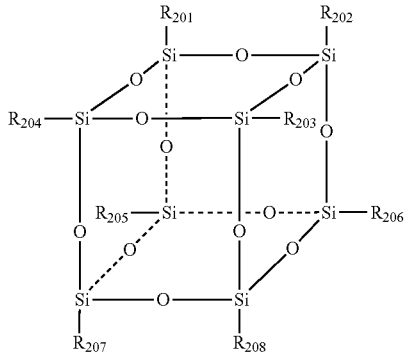

Compound (3)

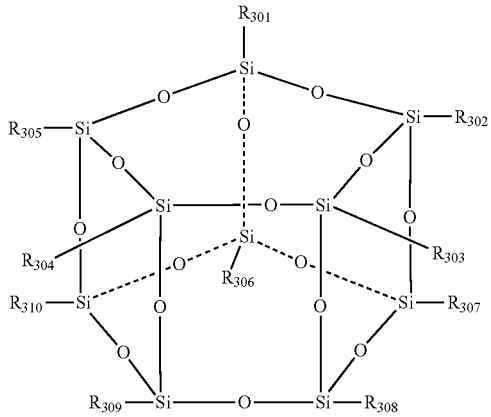

Compound (4)

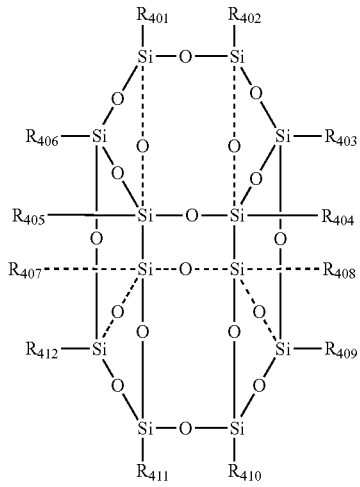

-continued

Compound (5)

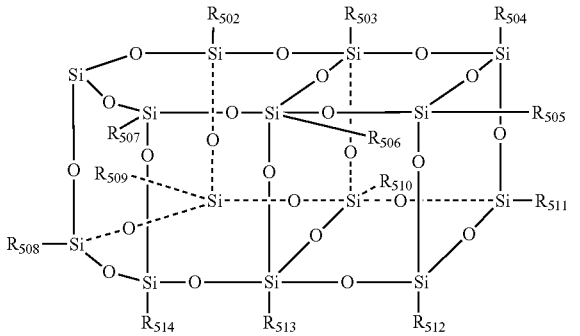

Compound (6)

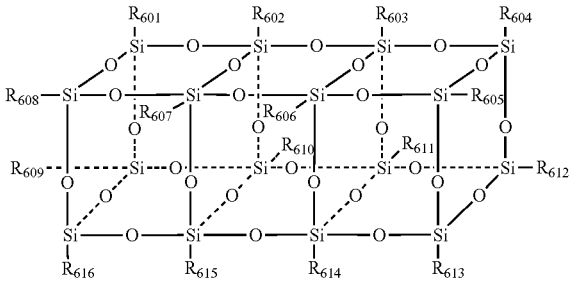

wherein $R^1$, $R^4$ and $R^6$ each independently represent a substituted or unsubstituted alkyl group, or a substituted or unsubstituted aryl group; $R^2$, $R^3$ and $R^5$ each independently represent a hydrogen atom or a substituted or unsubstituted alkyl group; $R_{101}$ to $R_{616}$ in the compounds (1) to (6) are each independently at least one selected from the group consisting of an unsubstituted alkyl group, an alkyl fluoride group, an unsubstituted aryl group and a group represented by the following Formula (7); and $R_{101}$ to $R_{616}$ in the compounds (1) to (6) are each independently at least one selected from the group consisting of a substituted or unsubstituted alkyl group, a substituted or unsubstituted aryl group, and a group represented by the following Formula (7):

(7)

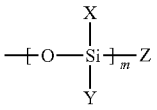

wherein X, Y and Z are each independently at least one selected from the group consisting of a substituted or unsubstituted alkyl group and a substituted or unsubstituted aryl group; and m is an integer of 1 to 20.

According to another aspect of the present invention, there is provided an electrophotographic apparatus comprising the above-described charging member and an electrophotographic photosensitive member which is arranged so as to come into contact with the charging member.

According to further aspect of the present invention, there is provided a process cartridge which integrally holds the above-described charging member and at least one member selected from the group consisting of an electrophotographic photosensitive member, a developing unit, a transfer unit and a cleaning unit, and is adapted so as to be detachably mountable on a main body of an electrophotographic apparatus.

According to the present invention, a charging member having a charging performance which is resistant to change even after long-term use, and being excellent in durability can be provided. This is considered to be because the surface layer of the charging member according to the present invention has been reinforced by silsesquioxanes according to compounds (1) to (6), which fill the gap in polysiloxanes according to the present invention at a molecular level. As a result, it is considered that the surface layer can hold uniform mechanical strength and is resistant to wear even by friction with the electrophotographic photosensitive member in contact charging.

Further features of the present invention will become apparent from the following description of exemplary embodiments with reference to the attached drawings.

DESCRIPTION OF THE EMBODIMENTS

Figure 1:
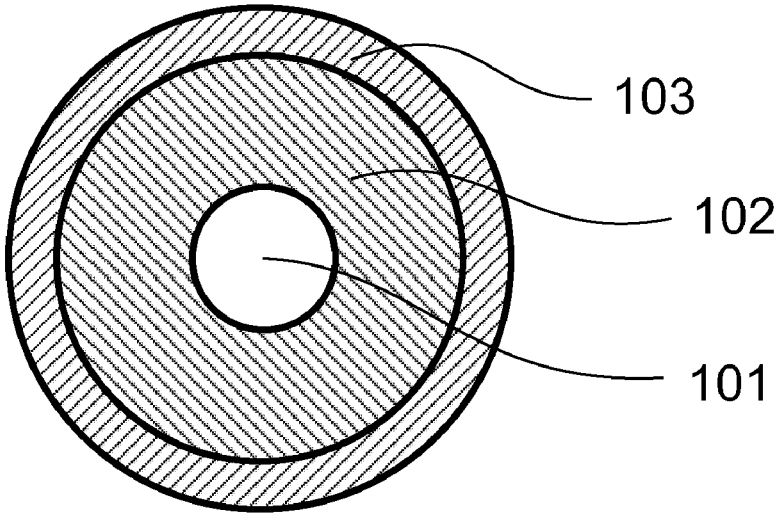
FIG. 1 is a cross-sectional view of a plane perpendicular to the axial direction of a charging member according to the present invention.

Preferred embodiments of the present invention will now be described in detail in accordance with the accompanying drawings.

The charging member according to the present invention is a charging member which has a support, a electroconductive elastic layer and a surface layer in this order, wherein the surface layer includes polysiloxane and silsesquioxane.

Polysiloxane

The polysiloxane has a first unit represented by $SiO_{0.5}R^1(OR^2)(OR^3)$, a second unit represented by $SiO_{1.0}R^4(OR^5)$ and a third unit represented by $SiO_{1.5}R^6$. Here, $R^1$, $R^4$ and $R^6$ each independently represent a substituted or unsubstituted alkyl group, or a substituted or unsubstituted aryl group. Examples of the unsubstituted alkyl group include a methyl group, an ethyl group, a propyl group, a hexyl group and a decyl group. In addition, the substituted alkyl group includes an alkyl fluoride group in which at least one hydrogen atom of the previously described alkyl group is substituted with a perfluoroalkyl group having 1 to 10 carbon atoms, and a glycidoxy propyl group. In addition, the unsubstituted aryl group includes a phenyl group. Furthermore, the substituted aryl group includes a pentafluorophenyl group and a 4-perfluorotolyl group. $R^2$, $R^3$, and $R^5$ each independently represent a hydrogen atom, or a substituted or unsubstituted alkyl group. The unsubstituted alkyl group includes a methyl group, an ethyl group, a propyl group, a hexyl group and a decyl group. In addition, the substituted alkyl group includes a 2-methoxyethyl group and an acetyl group.

The above described "first unit represented by $SiO_{0.5}R^1(OR^2)(OR^3)$" means a range A1 surrounded by a square in the polysiloxane as represented in the following Formula (i). Because an oxygen atom (O of Si—O—Si) which is not an oxygen atom of an alkoxy group in the range A1 is bonded to two silicon atoms, the number of the oxygen atoms (O of Si—O—Si) bonded to one silicon atom is considered to be 0.5 atoms.

A1

(i)

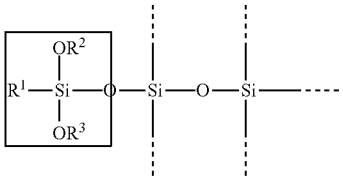

The above described "second unit represented by $SiO_{1.0}R^4(OR^5)$" is similar to "the first unit represented by $SiO_{0.5}R^1(OR^2)(OR^3)$", and specifically means a range A2 surrounded by a square in the polysiloxane as represented in the following Formula (ii).

A2

(ii)

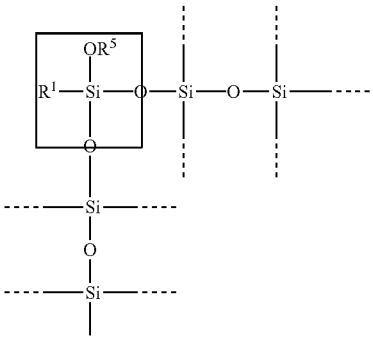

The above described "third unit represented by $SiO_{1.5}R^6$" is similar to "the first unit represented by $SiO_{0.5}R^1(OR^2)(OR^3)$", and specifically means a range A3 surrounded by a square in the polysiloxane as represented in the following Formula (iii).

A3

(iii)

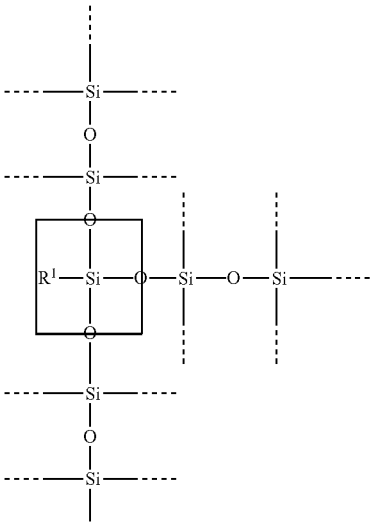

The above described polysiloxane can have at least one group selected from the group consisting of a substituted alkyl group, an unsubstituted alkyl group, a substituted aryl group and an unsubstituted aryl group.

The surface layer of the charging member including the above described polysiloxane according to the present invention can be formed through the following steps (I) to (III), for instance.

(I) A condensation step of condensing a hydrolyzable silane compound and a hydrolyzable silane compound having a cationically polymerizable group by hydrolysis, (II) a mixing step of adding silsesquioxanes represented by a compound (1) to a compound (6) to the hydrolyzable condensate obtained in the step (I), and (III) a cross-linking step of cross-linking and curing the mixture obtained in the step (II) by cleaving the cationically polymerizable group.

The amount of water to be used for hydrolysis in the above described condensation step (I) can be in the range of 20 to 50 mass % with respect to the total amount of the hydrolyzable silane compounds to be used in the above described step (I). A hydrolyzable silane compound which has at least one group selected from the substituted or unsubstituted aryl groups can be used as the above described hydrolyzable silane compound. Among these compounds, a hydrolyzable silane compound which has an aryl group having a structure represented by the following Formula (8) can be used:

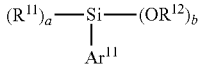

(8)

wherein $R^{11}$ and $R^{12}$ each independently represent a substituted or unsubstituted alkyl group; $Ar^{11}$ represents a substituted or unsubstituted aryl group; and a is an integer of 0 or more and 2 or less, b is an integer of 1 or more and 3 or less, and a+b=3.

The substituted alkyl group includes an alkyl fluoride group, and the unsubstituted alkyl group includes methyl, ethyl, propyl, hexyl and decyl. Among them, the alkyl group represented by $R^{11}$ and $R^{12}$ can be the methyl group, the ethyl group and the propyl group. In addition, the aryl group $Ar^{11}$ in the above described Formula (8) can be a phenyl group. When (a) in the above described Formula (8) is 2, two groups of $R^{11}$ may be the same or different. In addition, when (b) in the above described Formula (8) is or 3, two or three groups of $R^{12}$ may be the same or different. Specific examples of the hydrolyzable silane compound which has an aryl group represented by the above described Formula (8) are described below.

(8-1): phenyltrimethoxysilane (8-2): phenyltriethoxysilane (8-3): phenyltripropoxysilane As for the above described hydrolyzable silane compound which has an aryl group, only one type may be used or two or more types may be used.

The above described hydrolyzable silane compound having a cationically polymerizable group can be a hydrolyzable silane compound which has a structure represented by the following Formula (9):

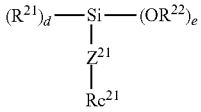

(9)

In the Formula (9), $R^{21}$ and $R^{22}$ each independently represent a substituted or unsubstituted alkyl group, $Z^{21}$ represents a divalent organic group, and $Rc^{21}$ represents a cationically polymerizable group which can produce an oxyalkylene group by cleavage; d is an integer of 0 or more and 2 or less, e is an integer of 1 or more and 3 or less, and d+e=3. The cationically polymerizable group $Rc^{21}$ in the above described Formula (9) represents a cationically polymerizable organic group which can produce an oxyalkylene group by cleavage. Specific examples of $Rc^{21}$ include, for instance, a cyclic ether group such as a glycidoxy group, an epoxy group and an oxetane group, or a vinyl ether group. Among the above groups, the glycidoxy group or the epoxy group can be employed from a viewpoint that the material is easily available and the reaction is easily controlled. In addition, the above described oxyalkylene group is a divalent group (occasionally referred to as "alkylene ether group") which has a structure represented by —O—R— (—R—: alkylene group).

The substituted alkyl group represented by $R^{21}$ and $R^{22}$ in the above described Formula (9) includes an alkyl fluoride group, and the unsubstituted alkyl group includes methyl, ethyl, propyl, hexyl and decyl. Among the groups, $R^{21}$ and $R^{22}$ can be an unsubstituted alkyl group having 1 to 3 carbon atoms or a branched alkyl group, and further can be the methyl group or the ethyl group. The divalent organic group $Z^{21}$ in the above described Formula (9) includes, for instance, an alkylene group or an arylene group. Among the groups, an alkylene group having 1 to 6 carbon atoms can be employed, and furthermore, an ethylene group and a propylene group can be employed. In addition, e in the above described Formula (9) can be 3. When d in the above described Formula (9) is 2, two groups of $R^{21}$ may be the same or different. When e in the above described Formula (9) is 2 or 3, two or three groups of $R^{22}$ may be the same or different. Specific examples of the hydrolyzable silane compound which has a structure represented by the above described Formula (9) are described below.

(9-1): glycidoxypropyltrimethoxysilane (9-2): glycidoxypropyltriethoxysilane (9-3): epoxycyclohexylethyltrimethoxysilane (9-4): epoxycyclohexylethyltriethoxysilane As for the above described hydrolyzable silane compound which has a cationically polymerizable group, only one type may be used or two or more types may be used.

In the above described step (I), not only the hydrolyzable silane compound which has an aryl group and the hydrolyzable silane compound which has the cationically polymerizable group are used, but also the hydrolyzable silane compound which has the structure represented by the following Formula (10) can be concomitantly used. Thereby, the release properties of the surface of the charging member to be manufactured can be enhanced. By using the hydrolyzable silane compound which has the structure represented by the following Formula (10), the obtained polysiloxane results in being a polysiloxane which has an alkyl fluoride group (perfluoroalkyl group).

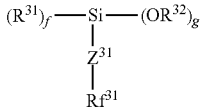

(10)

In the Formula (10), $R^{31}$ and $R^{32}$ each independently represent a substituted or unsubstituted alkyl group, $Z^{31}$ represents a divalent organic group, and $Rf^{31}$ represents an alkyl fluoride group having 1 or more and 11 or less carbon atoms; and f is an integer of 0 to 2, g is an integer of 1 to 3, and f+g=3. In $R^{31}$ and $R^{32}$, the substituted alkyl group includes an alkyl fluoride group, and the unsubstituted alkyl group includes methyl, ethyl, propyl, hexyl and decyl. Among the groups, the alkyl group represented by $R^{31}$ and $R^{32}$ can be an alkyl group having 1 to 3 carbon atoms or a branched alkyl group, and further can be the methyl group and the ethyl group. In addition, the divalent organic group $Z^{31}$ in the above described Formula (10) includes, for instance, an alkylene group or an arylene group. Among the groups, an alkylene group having 1 to 6 carbon atoms can be employed, and furthermore, an ethylene group can be employed. In addition, the alkyl fluoride group having 1 or more and 11 or less carbon atoms of $Rf^{31}$ in the above described Formula (10) can be particularly a straight-chained alkyl fluoride group having 6 to 11 carbon atoms from a viewpoint of treatability. In the above described Formula (10), g can be 3. In addition, when f in the above described Formula (10) is 2, two groups of $R^{31}$ may be the same or different. When g in the above described Formula (10) is 2 or 3, two or three groups of $R^{32}$ may be the same or different. Specific examples of the hydrolyzable silane compound which has the structure represented by the above described Formula (10) are described below. In the following (10-1) to (10-6), R represents a methyl group or an ethyl group.

(10-1): $CF_3$—$(CH_2)_2$—Si—$(OR)_3$ (10-2): $CF_3$— $(CF_2)$— $(CH_2)_2$—Si—$(OR)_3$ (10-3): $CF_3$— $(CF_2)_3$—$(CH_2)_2$—Si—$(OR)_3$ (10-4): $CF_3$— $(CF_2)_5$—$(CH_2)_2$—Si—$(OR)_3$ (10-5): $CF_3$—$(CF_2)_7$—$(CH_2)_2$—Si—$(OR)_3$ (10-6): $CF_3$— $(CF_2)_9$—$(CH_2)_2$—Si—$(OR)_3$

Among the above described compounds (10-1) to (10-6), (10-4) to (10-6) can be used. As for the above described hydrolyzable silane compound which has an alkyl fluoride group, only one type may be used or two or more types may be used.

In the present invention, hydrolyzable silane other than the above described hydrolyzable silane compounds may be further concomitantly used, in the above described step (I). The hydrolyzable silane other than the above described hydrolyzable silane compounds includes, for instance, a hydrolyzable silane compound which has a structure represented by the following Formula (11):

$$(R^{41})_h—Si—(OR^{42})_k \quad (11)$$

wherein $R^{41}$ represents a substituted or unsubstituted alkyl group; $R^{42}$ represents a saturated or unsaturated monovalent hydrocarbon group; and h is an integer of 0 to 3, k is an integer of 1 to 4, and h+k=4.

In the above described Formula (11), $R^{41}$ can be an unsubstituted alkyl group having 1 to 21 carbon atoms. In the above described Formula (11), h can be an integer of 1 to 3, and particularly can be 1. In addition, in the above described Formula (11), k can be an integer of 1 to 3, and particularly can be 3. In the above described Formula (11), the saturated or unsaturated monovalent hydrocarbon group of $R^{42}$ includes, for instance, an alkyl group, an alkenyl group or an aryl group. Among the groups, $R^{42}$ can be an unsubstituted alkyl group having 1 to 3 carbon atoms or a branched alkyl group, and further can be a methyl group, an ethyl group or an n-propyl group. When h in the above described Formula (11) is 2 or 3, two or three groups of $R^{41}$ may be the same or different. In addition, when k in the above described Formula (11) is 2, 3 or 4, two, three or four groups of $R^{42}$ may be the same or different. As for the hydrolyzable silane compound which has the structure represented by the above described Formula (II), only one type may be used or two or more types may be used. Specific examples of the hydrolyzable silane compound which has the structure represented by the above described Formula (11) are described below.

(11-1): methyltrimethoxysilane (11-2): methyltriethoxysilane (11-3): methyltripropoxysilane (11-4): ethyltrimethoxysilane (11-5): ethyltriethoxysilane (11-6): ethyltripropoxysilane (11-7): propyltrimethoxysilane (11-8): propyltriethoxysilane (11-9): propyltripropoxysilane (11-10): hexyltrimethoxysilane (11-11): hexyltriethoxysilane (11-12): decyltrimetoxysilane (11-13): decyltriethoxysilane (11-14): decyltripropoxysilane Silsesquioxane The surface layer according to the present invention includes silsesquioxane having a specific chemical structure in addition to the above described polysiloxane. Specifically, the surface layer includes at least one compound selected from the group consisting of the following compounds (1) to (6).

Compound (1)

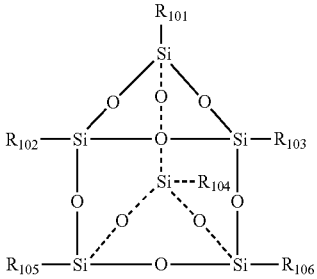

Compound (2)

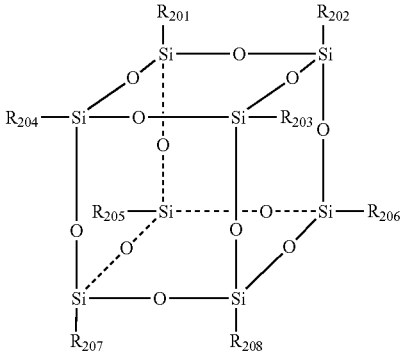

-continued

Compound (3)

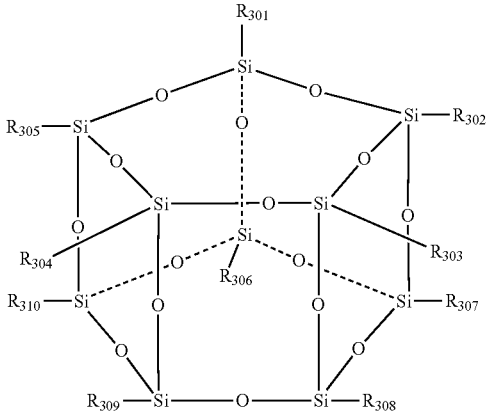

Compound (4)

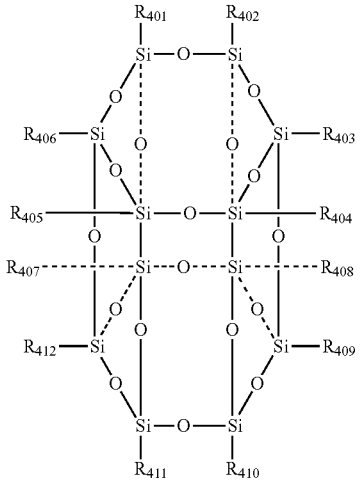

Compound (5)

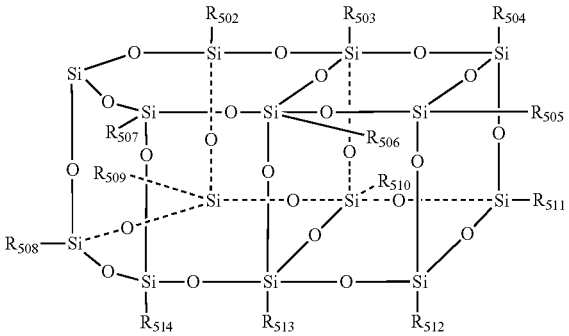

Compound (6)

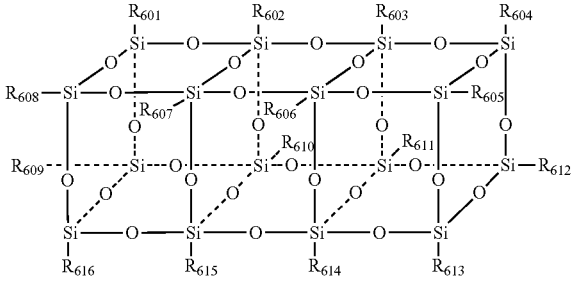

In the above described compound (1) to compound (6), $R_{101}$ to $R_{616}$ are each independently at least one selected from the group consisting of a substituted or unsubstituted alkyl group, a substituted or unsubstituted aryl group, and a group represented by the following Formula (7).

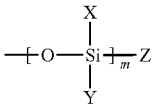

(7)

In the Formula (7), X, Y and Z are each independently at least one selected from the group consisting of a substituted or unsubstituted alkyl group and a substituted or unsubstituted aryl group, and m is an integer in the range of 1 to 20.

In the above described compound (1) to compound (6), $R_{101}$ to $R_{616}$ can be each independently at least one selected from the group consisting of an unsubstituted alkyl group having 1 to 20 carbon atoms and a group represented by the above described Formula (7). Thereby, the solubility of silsesquioxane with respect to polysiloxane can be enhanced. Here, when any substituent selected from $R_{101}$ to $R_{616}$ is the above described Formula (7), X and Y can each be an alkyl group having 1 to 3 carbon atoms, Z can be an alkyl group having 1 to 3 carbon atoms or a cycloalkenyl-modified alkyl group, and m can be 1. Because a difference between the surface tensions of the polysiloxane and the silsesquioxane can be reduced, compatibility to each other can be enhanced. As a result, the network structure of the polysiloxane is filled with more uniformly with the silsesquioxane, and the mechanical strength of the surface layer is further uniformized. Examples of the substituted alkyl group in $R_{101}$ to $R_{616}$ can include: an alkyl fluoride group in which at least one hydrogen atom of the alkyl group having 1 to 20 carbon atoms is substituted with a fluorine atom; an alicyclic hydrocarbon group in which the hydrogen atom is substituted or unsubstituted; a substituted or unsubstituted aryl group; and further an alkyl group which is substituted with a group represented by the following Formula (12).

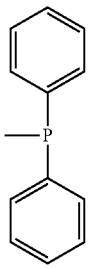

(12)

A silsesquioxane having the structure represented by the above described compound (2) can be used as the silsesquioxane, from the viewpoint of solubility with respect to the polysiloxane. At this time, $R_{201}$ to $R_{208}$ can include a combination in which $R_{201}$ to $R_{208}$ are each a branched alkyl group having 1 to 20 carbon atoms or a group represented by the Formula (7), and all of $R_{201}$ to $R_{208}$ are made the same group. When $R_{201}$ to $R_{208}$ employ a group represented by the above described Formula (7), X and Y in the Formula (7) can each be a straight-chain alkyl group having 1 to 4 carbon atoms, and Z can be an ethyl group which has been modified by a cycloalkenyl group (3-cyclohexene-1-yl, for instance). By setting the number of Si atoms constituting the silsesquioxane so as not to be too many, gaps in the network structure of the polysiloxane can be filled with the silsesquioxane and the mechanical strength of the surface layer film can be uniformly enhanced.

The target of the content of the silsesquioxane with respect to the above described polysiloxane is 1.0 mol or more and 50.0 mol or less with respect to 100 mol of the above described polysiloxane, and particularly 10.0 mol or more and 30.0 mol or less.

Next, the configuration of the charging member according to the present invention will be described below, while including a specific method of forming the surface layer.

FIG. 1 illustrates a schematic sectional view in a plane perpendicular to the axial direction of a charging roller which is one example of the charging member according to the present invention. In FIG. 1, a support 101, a electroconductive elastic layer 102 and a surface layer 103 are illustrated. The charging member can have a configuration having the electroconductive elastic layer 102 provided between the support 101 and the surface layer 103, from the viewpoint of sufficiently securing a nipping region at which the electrophotographic photosensitive member abuts on the charging member, as is illustrated in FIG. 1, for instance. In other words, the charging member can have the support 101, the electroconductive elastic layer 102 formed on the support 101, and the surface layer 103 formed on the electroconductive elastic layer 102. In addition, one or more other layers may be provided between the support 101 and the electroconductive elastic layer 102 or between the electroconductive elastic layer 102 and the surface layer 103.

The charging member having the support, the electroconductive elastic layer formed on the support, and the surface layer formed on the electroconductive elastic layer will be described as an example below.

Support

A usable support of the charging member includes a support made from a metal (made from an alloy) such as iron, copper, stainless steel, aluminum, an aluminum alloy and nickel.

Elastic Layer

A usable material for constituting the electroconductive elastic layer can be one or more elastomers such as a rubber and a thermoplastic elastomer which are used for an elastic layer (electroconductive elastic layer) of a conventional charging member. Specific examples of the rubber include an urethane rubber, a silicone rubber, a butadiene rubber, an isoprene rubber, a chloroprene rubber, a styrene-butadiene rubber, an ethylene-propylene rubber, a polynorbornene rubber, a styrene-butadiene-stylene rubber, an acrylonitrile rubber, an epichlorohydrine rubber and an alkyl ether rubber.

The above described thermoplastic elastomer includes a styrene-based elastomer and an olefin-based elastomer, for instance. The commercialized product of the styrene-based elastomer includes "RABALON" (which is trade name and is made by Mitsubishi Chemical Corporation) and "SEPTON compound" (which is trade name and is made by KURARAY CO., LTD.), for instance. The commercialized product of the olefin-based elastomer includes "THERMORUN" (which is trade name and is made by Mitsubishi Chemical Corporation), "Milastomer" (which is trade name and is made by Mitsui Chemicals, Inc.), "Sumitomo TPE" (which is trade name and is made by Sumitomo Chemical Co., Ltd.) and "SANTOPRENE" (which is trade name and is made by ADVANCED ELASTOMER SYSTEMS, L.P.), for instance.

The conductivity of the electroconductive elastic layer can be controlled to a predetermined value by appropriately using a electroconductive agent. The electrical resistance of the electroconductive elastic layer can be adjusted by appropriately selecting the type and the amount of the electroconductive agent to be used. The suitable range of the electrical resistance is $10^2$ to $10^8\Omega$, and the more suitable range is $10^3$ to $10^6\Omega$.

The electroconductive agent to be used for the electroconductive elastic layer includes a cationic surfactant, an anionic surfactant, an amphoteric surfactant, an antistatic agent and an electrolyte, for instance. Examples of the above described cationic surfactant include a quaternary ammonium salt. Specific examples of the quaternary ammonium ion of the quaternary ammonium salt include a lauryltrimethylammonium ion and a stearyltrimethylammonium ion. In addition, specific examples of a counter ion of the quaternary ammonium ion include a halide ion and a perchlorate ion. In addition, specific examples of the above described anionic surfactant include an aliphatic sulfonate and a higher alcohol sulfate salt.

Specific examples of the antistatic agent include a nonionic antistatic agent such as a higher alcohol-ethyleneoxide and polyethylene glycol fatty acid ester. The electrolyte includes salts of metals (Li, Na, K and the like) in Group 1 of the Periodic Table, and specifically includes salts ($LiCF_3SO_3$, $NaClO_4$ and the like) of metals in Group 1 of the Periodic Table.

The electroconductive agent includes salts ($Ca(ClO_4)_2$ and the like) of metals (Ca, Ba and the like) in Group 2 of the Periodic Table. In addition, the usable electroconductive agent can also include conductive carbon black, graphite, a metal oxide (tin oxide, titanium oxide, zinc oxide and the like), a metal (nickel, copper, silver, germanium and the like) and a conductive polymer (polyaniline, polypyrrole, polyacetylene and the like).

An inorganic or organic filler or a cross-linking agent may also be added to the electroconductive elastic layer. The filler includes, for instance, silica (white carbon), calcium carbonate, magnesium carbonate, clay, talc, bentonite, zeolite, alumina, barium sulfate and aluminum sulfate. The cross-linking agent includes, for instance, sulfur, a peroxide, a cross-linking auxiliary, a cross-linking promoter, a cross-linking promoting auxiliary and a cross-linking retarder.

The electroconductive elastic layer can have a hardness of 70 degrees or more and further particularly of 73 degrees or more by Asker C hardness, from the viewpoint of suppressing the deformation of the charging member when having made the charging member abut on the electrophotographic photosensitive member which is a body to be charged. In the present invention, the Asker C hardness was measured by making a pushing needle of an ASKER Durometer Type C (made by KOBUNSHI KEIKI CO., LTD.) abut on the surface of a measuring object on the condition of loading a weight of 1,000 g.

One example of the specific methods of forming the surface layer will be described below. Firstly, a hydrolyzable condensate is obtained by subjecting a hydrolyzable silane compound, a hydrolyzable silane compound having a cationically polymerizable group, and a hydrolyzable silane compound other than the above described ones as needed, to a hydrolysis reaction in the presence of water (step I). The hydrolyzable condensate having a desired degree of condensation can be obtained by controlling a temperature, pH and the like in the hydrolysis reaction.

In addition, the degree of condensation may be controlled also by using a metal alkoxide and the like as a catalyst of the hydrolysis reaction in the hydrolysis reaction. The metal alkoxide includes, for instance, aluminum alkoxide, titanium alkoxide, zirconium alkoxide, and a complex (acetylacetone complex and the like) thereof.

The amount of water to be used for hydrolysis in the above described condensation step (I) can be in the range of 20 to 50 mass % with respect to the total amount of the hydrolyzable silane compounds to be used in the above described step (I).

In addition, a hydrolyzable silane compound which has at least one group selected from substituted or unsubstituted aryl groups can be used as the above described hydrolyzable silane compound. Among these compounds, a hydrolyzable silane compound which has an aryl group having a structure represented by the above described Formula (8) can be further used.

In addition, the content of each group in the polysiloxane obtained by cleaving the cationically polymerizable group in the above described step (III) can be in the following range with respect to the total mass of the above described polysiloxane.

Content of an aryl group: 2 mass % or more and 30 mass % or less

Content of an alkyl group: 2 mass % or more and 30 mass % or less

Content of an oxyalkylene group: 5 mass % or more and 50 mass % or less

Content of a siloxane moiety: 30 mass % or more and 60 mass % or less

The total content of the above described aryl group, alkyl group and oxyalkylene group can be set at 20 to 40 mass %, and further can be set at 25 to 35 mass %. The hydrolyzable silane compound having the aryl group can be further blended so as to be in the range of 10 to 50 mol parts with respect to all hydrolyzable silane compounds.

In addition, when the hydrolyzable silane compound having the structure represented by the above described Formula (10) is concomitantly used in the above described step (I), the content of each group in the polysiloxane obtained by cleaving the cationically polymerizable group in the above described step (III) can be in the following range with respect to the total mass of the above described polysiloxane.

Content of an aryl group: 2 mass % or more and 30 mass % or less

Content of an alkyl group: 2 mass % or more and 30 mass % or less

Content of an oxyalkylene group: 5 mass % or more and 50 mass % or less

Content of an alkyl fluoride group: 2 mass % or more and 30 mass % or less

Content of a siloxane moiety: 30 mass % or more and 70 mass % or less

The total content of the above described aryl group, alkyl group, oxyalkylene group, alkyl fluoride group and siloxane moiety can be set at 10 to 60 mass % with respect to the total mass of the polysiloxane, and further can be set at 20 to 50 mass %. The hydrolyzable silane compound having the cationically polymerizable group and the hydrolyzable silane compound containing the alkyl fluoride group can further be blended so as to make the molar ratio thereof be in the range of 10:1 to 1:10.

Next, either of or two or more of silsesquioxane compounds represented by the compounds (1) to (6) are added to and are mixed with the obtained hydrolyzable condensate (step II).

The usable silsesquioxane represented by the compounds (1) to (6) also includes a commercialized product, and a substance produced by synthesizing with a known method. Specifically, the silsesquioxane can be synthesized by hydrolyzing a silane compound having an arbitrary substituent and three hydrolyzable groups, and subsequently dehydration-condensing the hydrolyzed products. The hydrolyzable group includes an alkoxy group and a chlorine atom. The octamethyl-polyoctasilsesquioxane can be obtained, for instance, by hydrolyzing methyltrichlorosilane in the presence of water, a solvent and a basic catalyst, and dehydration-condensing the hydrolyzed products. The basic catalyst includes: an alkali metal oxide such as potassium hydroxide, sodium hydroxide and cesium hydroxide; and an ammonium hydroxide salt such as tetramethylammonium hydroxide and benzyltrimethylammonium hydroxide. Among the basic catalysts, tetramethylammonium hydroxide can be used from the point of having high catalytic activity.

The water to be used for hydrolysis can be supplemented from an aqueous solution of the basic catalyst, or may also be separately added. The amount of water is a sufficient amount for hydrolyzing the hydrolyzable group or more, and can be 1.0 to 1.5 times the stoichiometric amount. The usable solvent includes alcohols such as methanol, ethanol and 2-propanol, and other polar solvents. The solvent can be a lower alcohol having 1 to 6 carbon atoms, from the viewpoint of having compatibility with water. The reaction temperature in the synthesis can be 0 to 60° C., and further can be 20 to 40° C. Then, the hydrolyzable group remaining in an unreacted state can be suppressed, and an increase in the molecular weight of the hydrolysis product due to too fast a reaction speed can also be suppressed. The reaction period of time can be two hours or longer, in order to sufficiently progress hydrolysis. After the hydrolysis reaction has been finished, water or a water-containing reaction solvent may also be separated. A usable technique of separating the water or the water-containing reaction solvent includes techniques of evaporation under reduced pressure and the like. In order to sufficiently remove moisture and other impurities, a unit can be adopted which adds a nonpolar solvent to the solution, dissolves the hydrolysis product in the nonpolar solvent, washes the resultant solution with a saline solution or the like, and then dries the solution with a desiccating agent such as anhydrous magnesium sulfate.

The structure of the obtained silsesquioxane can be confirmed by using a $^{29}$Si-nuclear magnetic resonance spectrum and a Fourier transform infrared absorption spectrum.

When the total solid content of the polysiloxane in which all of the hydrolyzable silane compounds are dehydration-condensed is supposed to be 100 mol, a target of the content of the silsesquioxanes represented by the compounds (1) to (6) to be added is 1.0 mol or more and 50.0 mol or less, and particularly is 10.0 mol or more and 30.0 mol or less.

Next, an application liquid for forming a surface layer containing the hydrolyzable condensate and the silsesquioxane compounds represented by the compounds (1) to (6) is prepared, and a coating film of the application liquid is formed on a layer directly under the surface layer, which is specifically an elastic layer.

When the application liquid is prepared, a solvent may also be used in addition to the hydrolyzable condensate, so as to enhance applicability. The solvent includes, for instance: an alcohol such as ethanol and 2-butanol; ethyl acetate; methyl isobutyl ketone; methyl ethyl ketone; and a mixture prepared by mixing them. In addition, when the application liquid for the surface layer is applied onto the electroconductive elastic layer, such methods can be adopted as an application method with the use of a roll coater, a dip application method and a ring application method.

Next, the coating film is irradiated with an active energy beam. Then, the cationically polymerizable group in the hydrolyzable condensate contained in the coating film is cleaved. Thereby, the hydrolyzable condensate in the surface application liquid layer can be cross-linked. The hydrolyzable condensate is cured by cross-linking and the surface layer is formed by drying the cured product (step III).

The above described active energy beam can be ultraviolet light. When the ultraviolet light is used for a cross-linking reaction, the hydrolyzable condensate can be cross-linked in a short period of time (15 minutes or less). In addition, heat is little generated, and the surface layer is resistant to wrinkles and cracks thereon. When the cross-linking reaction is allowed to proceed by the ultraviolet light which generates little heat, the surface layer has higher adhesiveness to the electroconductive elastic layer, consequently can sufficiently follow the expansion/contraction of the electroconductive elastic layer, and this can suppress the occurrence of wrinkles or cracks on the surface layer due to changes in the temperature and the humidity of the environment. When the cross-linking reaction is allowed to proceed by the ultraviolet light, the deterioration of the electroconductive elastic layer due to a heat history can be suppressed, and accordingly the deterioration of electrical properties of the electroconductive elastic layer also can be suppressed. A high-pressure mercury lamp, a metal halide lamp, a low-pressure mercury lamp, an excimer UV lamp and the like can be used for irradiation with ultraviolet light. Among the lamps, an ultraviolet light source can be used which abundantly contains ultraviolet light with wavelengths of 150 to 480 nm.

Note that the integrated light intensity of the ultraviolet light is defined as follows:

integrated light intensity of ultraviolet light [mJ/cm$^2$]= intensity of ultraviolet light [mW/cm$^2$]×irradiation period of time [s].

The integrated light intensity of the ultraviolet light can be adjusted with the irradiation period of time, a lamp output, a distance between the lamp and an object to be irradiated and the like. The integrated light intensity may have a gradient within the irradiation period of time. When a low-pressure mercury lamp is used, the integrated light intensity of the ultraviolet light can be measured by using the ultraviolet-light integrated light intensity meter "UIT-150-A" (trade name) or "UVD-S254" (trade name) made by USHIO INC. When the excimer UV lamp is used, the integrated light intensity of the ultraviolet light can be measured by using the ultraviolet-light integrated light intensity meter "UIT-150-A" (trade name) or "VUV-S172" (trade name) made by USHIO INC.

In the cross-linking reaction, a cationic polymerization catalyst (polymerization initiator) can be made to coexist from the viewpoint of enhancing cross-linking efficiency. Because an epoxy group, for instance, shows high reactivity to an onium salt of Lewis acid which is activated by an active energy beam, when the above described cationically polymerizable group is the epoxy group, the onium salt of the Lewis acid can be used as the cationic polymerization catalyst.

Other cationic polymerization catalysts include, for instance, a borate salt, a compound having an imide structure, a compound having a triazine structure, an azo compound and a peroxide. Among various cationic polymerization catalysts, an aromatic sulfonium salt and an aromatic iodonium salt can be used as the cationic polymerization catalyst from the viewpoint of sensitivity, stability and reactivity. Particularly a bis(4-tert-buthylphenyl)iodonium salt and a compound (trade name: "ADEKA OPTOMER-SP150", made by ADEKA CORPORATION) having the structure represented by the following Formula (13) can further be used. In addition, a compound (trade name: "IRGACURE 261", made by Ciba Specialty Chemicals) having the structure represented by the following Formula (14) also can be further used.

(13)

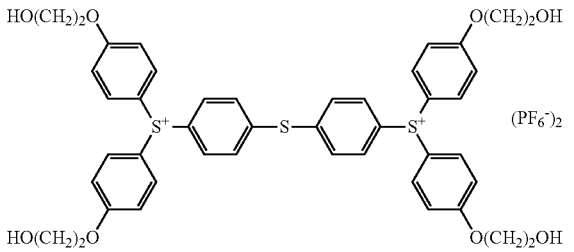

(14)

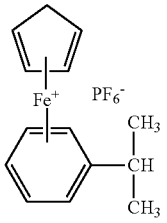

The amount of the cationic polymerization catalyst to be used can be 0.1 to 3 mass % with respect to the amount of the hydrolyzable condensate.

The roughness (Rzjis; measured according to JIS B 0601: 2001) of the surface (=the surface of the surface layer) of the charging member can be 10 μm or less and further can be 7 μm or less from the viewpoint of suppressing the sticking of a toner or an external additive to the surface of the charging member. The modulus of elasticity of the surface layer of the charging member can be 30 GPa or less from the viewpoint of sufficiently securing a nipping region at which the charging member abuts on the electrophotographic photosensitive member. On the other hand, there is generally a tendency for the cross-linking density to decrease as the modulus of elasticity of the surface layer decreases. For this reason, when the electroconductive elastic layer is provided in the charging member, the modulus of elasticity of the surface layer can be 100 MPa or more from the viewpoint of suppressing contamination of the surface of the electrophotographic photosensitive member by a low-molecular-weight component in the electroconductive elastic layer bleeding to the surface of the charging member.

In addition, the target of the thickness of the surface layer can be 0.01 μm or more and 1.00 μm or less, and further can be 0.05 μm or more and 0.50 μm or less in particular. The thickness may be appropriately set in the above described range in consideration of suppressing the bleeding of the low-molecular-weight component out from the elastic layer to the surface of the charging member, and the charging performance of the charging member.

Figure 2:
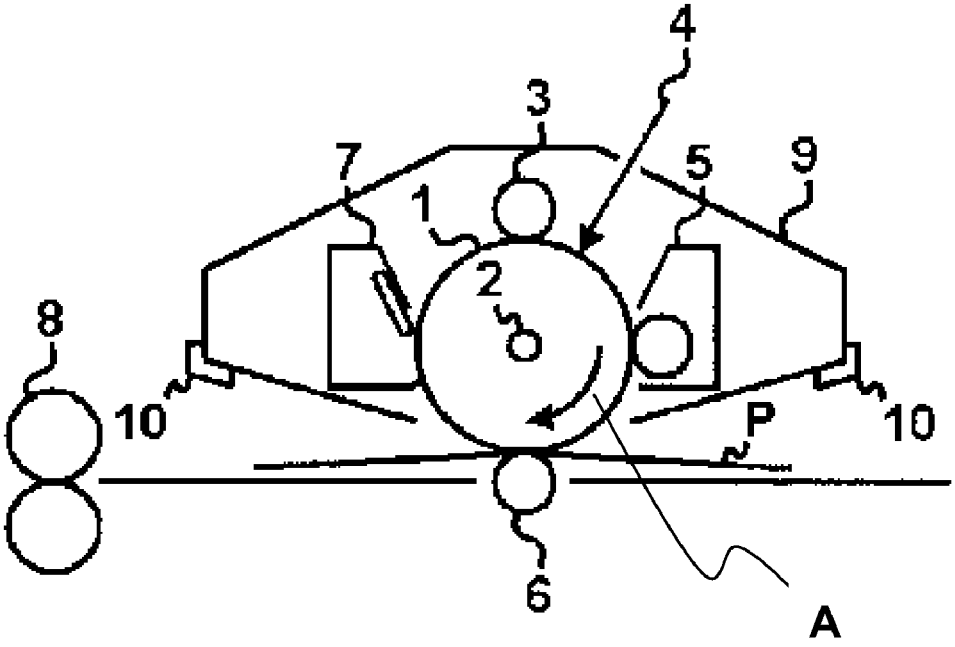
FIG. 2 is a schematic view of an electrophotographic apparatus provided with a process cartridge according to the present invention.

FIG. 2 illustrates a schematic configuration of one example of an electrophotographic apparatus provided with a process cartridge having the charging member according to the present invention. In FIG. 2, a cylindrical electrophotographic photosensitive member 1 is rotationally driven in a direction of the arrow A around the center of a shaft 2 at a predetermined peripheral velocity. A charging member 3 (roller-shaped charging member in FIG. 2) according to the present invention is arranged so as to come into contact with the electrophotographic photosensitive member 1. The charging member 3 is adapted so as to rotate in a forward direction to the rotation of the electrophotographic photosensitive member 1. The surface of the electrophotographic photosensitive member 1 which is rotationally driven is uniformly charged to a positive or negative predetermined potential by the charging member 3. Subsequently, the electrophotographic photosensitive member 1 receives an exposure light (image exposure light) 4 which is output from a light exposure unit (not illustrated) such as a slit exposure and a laser-beam scanning exposure. In this way, a static latent image corresponding to the target image is sequentially formed on the surface of the electrophotographic photosensitive member 1. When the surface of the electrophotographic photosensitive member 1 is charged by the charging member 3, a voltage of only DC voltage is applied to the charging member 3 from a voltage application unit (not illustrated), or a voltage of having superimposed AC voltage on DC voltage is applied. The charging member according to the present invention can be used for an electrophotographic apparatus having the voltage application unit for applying the voltage of only DC voltage to the charging member. As for the DC voltage, when the voltage of −1,000 V, for instance, has been applied to the charging member, the potential in a dark portion at this time can be approximately −500 V, and the potential in a light portion can be approximately −100 V.

The static latent image which has been formed on the surface of the electrophotographic photosensitive member 1 is developed (reversal-developed or normal-developed) by a toner contained in the developer of a developing unit 5 to become a toner image. Subsequently, the toner image which has been formed and carried on the surface of the electrophotographic photosensitive member 1 is sequentially transferred onto a transfer material (paper and the like) P by a transfer bias applied by a transfer unit (transfer roller and the like) 6. At this time, the transfer material P is sent to a portion (abutting portion) between the electrophotographic photosensitive member 1 and the transfer unit 6 from a transfer material supply unit (not illustrated), is taken out while being synchronized with the rotation of the electrophotographic photosensitive member 1, and is fed. The transfer material P which has received the toner image by transfer is separated from the surface of the electrophotographic photosensitive member 1, is introduced into a fixing unit 8, has the image fixed thereon, and is printed out to the outside of the apparatus as an image-formed product (print or copy). The developer (toner) which has not been transferred onto the transfer material P after the toner image has been transferred thereto is removed from the surface of the electrophotographic photosensitive member 1 by a cleaning unit (cleaning blade and the like) 7.

A process cartridge according to the present invention integrally holds the charging member 3 according to the present invention and at least one member selected from the group consisting of the electrophotographic photosensitive member 1, the developing unit 5, the transfer unit 6 and the cleaning unit 7, and is adapted so as to be detachably mountable on the main body of the electrophotographic apparatus. The process cartridge may also be formed into a cartridge which integrally supports the electrophotographic photosensitive member 1, the charging member 3, the developing unit 5 and the cleaning unit 7, for instance, as is illustrated in FIG. 2. In addition, the process cartridge may also be a process cartridge 9 which is detachably mounted on the main body of an electrophotographic apparatus by using a guide unit 10 such as a rail of the main body of the electrophotographic apparatus, for instance, as is illustrated in FIG. 2. In addition, the electrophotographic apparatus according to the present invention has a charging member according to the present invention and an electrophotographic photosensitive member which is arranged so as to come into contact with the charging member. In addition, the electrophotographic apparatus can have a voltage application unit for applying only DC voltage to the charging unit.

EXEMPLARY EMBODIMENTS

The present invention will now be described more specifically below with reference to specific examples. The "parts" in the Exemplary Embodiments means "parts by mass."

Exemplary Embodiment 1

Production of Charging Member

An A-kneaded rubber composition was produced by mixing the raw materials shown in the following Table 1 with a 6-liter pressurizing kneader "TD6-15MDX" (which is trade name and is made by TOSHIN CO., LTD.) at a filling factor of 70 vol % and a blade rotation speed of 30 rpm, for 16 minutes.

TABLE 1

| | |
|---|---|
| Nitrile rubber (trade name: JSR N230SV, made by JSR Corporation) | 100 parts |
| Carbon black (trade name: TOKABLACK #7360SB, made by TOKAI CARBON CO., LTD.) | 48 parts |
| Calcium carbonate (trade name: "NANOX#30", made by MARUO CALCIUM CO., LTD.) | 20 parts |
| Bentonite (trade name: "BEN-GEL SH", made by HOJUN Co., Ltd.) | 5 parts |
| Zinc oxide | 5 parts |
| Zinc stearate | 1 parts |

A kneaded material I was obtained by adding a vulcanizing accelerator and a vulcanizing agent shown in the following Table 2 to the above described A-kneaded rubber composition; cutting back the mixture to right and left 20 times in total, with an open roll having a roll diameter of 12 inches at a front roll rotation speed of 8 rpm, a rear roll rotation speed of 10 rpm, and a roll gap of 2 mm; and passing the cut back material 10 times through a narrow gap of 0.5 mm between rolls.

TABLE 2

| | |
|---|---|
| Vulcanization accelerator: Tetrabenzylthiuram disulfide (trade name: "PERKACIT-TBzTD", made by Flexsys) | 4.5 parts |
| Vulcanizing agent: Sulfur | 1.2 parts |

Subsequently, a primary vulcanization tube 1 for a electroconductive elastic layer was obtained by extruding the kneaded material I so as to be a cylindrical shape having an outer diameter of 9.4 mm and an inner diameter of 5.4 mm with a rubber extruder; cutting the extruded product into a length of 250 mm; and primary-vulcanizing with a water vapor of 160° C. for 30 minutes in a vulcanization can.

On the other hand, a columnar support made from steel (with a diameter of 6 mm and a length of 256 mm; nickel-plated surface) was prepared. A thermosetting adhesive (trade name: "METALOC U-20" made by TOYOKAGAKU KENKYUSHO CO., LTD.) containing a metal and a rubber was applied to a region on the columnar surface of this support up to 115.5 mm from both sides so as to sandwich the middle in an axial direction (a region with a width of 231 mm in total in the axial direction). The product was dried at 80° C. for 30 minutes, and was further dried at 120° C. for 1 hour. This support was inserted into the above described primary vulcanization tube 1 for the electroconductive elastic layer, and the product was heated at 160° C. for 1 hour to secondary-vulcanize the primary vulcanization tube 1 for the electroconductive elastic layer and cure the thermosetting adhesive. Thus, the conductive elastic roller 1 before surface polishing was obtained.

Subsequently, the both ends of the electroconductive elastic layer portion (rubber portion) of the conductive elastic roller 1 before surface polishing were cut out, and the width in the axial direction of the electroconductive elastic layer portion was set at 231 mm. A conductive elastic roller (conductive elastic roller after surface polishing) 2 was obtained by grinding the surface of the electroconductive elastic layer portion with a rotary grinding stone. This conductive elastic roller 2 had a electroconductive elastic layer having a crown shape with an end diameter of 8.2 mm and a center diameter of 8.5 mm, and the surface of this electroconductive elastic layer had a ten point height of irregularities (Rzjis) of 5.5 μm and a deflection of 28 μm. The electroconductive elastic layer had an Asker C hardness of 78 degrees.

The above described ten point height of irregularities (Rzjis) was measured according to JIS B 0601: 2001. The deflection was measured by using a high-accuracy laser measuring instrument "LSM-430v" (trade name) made by Mitutoyo Corporation. Specifically, the outer diameter was measured by using the measuring instrument, a difference between the maximum outer diameter value and the minimum outer diameter value was determined to be the deflection of difference in outer diameter, the outer diameters at five points were measured, and the average value of the deflections of difference in outer diameter at the five points was determined to be the deflection of a measured object. Furthermore, the above described Asker C hardness was measured by making a pushing needle of an ASKER Durometer Type C (made by KOBUNSHI KEIKI CO., LTD.) abut on the surface of a measuring object on the condition of applying 1,000 g by weight as was described above.

Next, a condensate-containing solution 1 of the hydrolyzable silane compound was obtained by mixing the raw materials shown in the following Table 3, stirring the mixture at room temperature, and heating the stirred mixture under reflux for 24 hours (120° C.)

TABLE 3

| | |
|---|---|
| Phenyltriethoxysilane (PhTES) (product number: KBE-103, made by Shin-Etsu Chemical Co., Ltd., molecular weight = 240.370 g/mol) | 42.03 g (0.179 mol which corresponds to 55.94 mol % with respect to the total amount of hydrolyzable silane compound) |
| Glycidoxypropyltriethoxysilane (GPTES) (product number: KBE-403, made by Shin-Etsu Chemical Co., Ltd., molecular weight = 278.418 g/mol) | 12.53 g (0.045 mol) |
| Hexyltrimethoxysilane (HETMS) (product number: KBE-3063, made by Shin-Etsu Chemical Co., Ltd., molecular weight = 206.356 g/mol) | 13.21 g (0.064 mol) |
| Tridecafluoro-1,1,2,2-tetrahydrooctyltriethoxysilane (FTS) (product number: SIT8175.0, made by Gelest, Inc., number of carbon atoms in perfluoroalkyl group = 6, molecular weight = 510.382 g/mol) | 16.33 g (0.032 mol) |
| Water | 25.93 g |
| Ethanol | 75.24 g |

To this condensate-containing solution 1 was added 279.56 g of a solution obtained by diluting silsesquioxane No. 1 (product number: 52684-3, made by Sigma-Aldrich Japan K.K.) with methyl ethyl ketone (hereinafter referred to as MEK) to 10 mass % so that the silsesquioxane No. 1 had 10.0 mol with respect to a total amount of 0.320 mol of the above described hydrolyzable silane compound added. A condensate-containing alcohol solution 1 having a solid content of 7 mass % was prepared by adding the condensate-containing solution 1 which contains this silsesquioxane No. 1 to a mixture solvent of 2-butanol/ethanol. An application liquid 1 for the surface layer having 2 mass % of a solid content was prepared by preparing a solution in which an aromatic sulfonium salt (trade name: "ADEKA OPTOMER-SP-150", made by ADEKA CORPORATION) was diluted to 10 mass % with methyl isobutyl ketone (hereinafter referred to as MIBK), as a photo cationic polymerization initiator; adding 2 parts by mass of the solution to the condensate-containing alcohol solution 1; and diluting the solution with ethanol.

Next, the application liquid 1 for the surface layer was applied onto the electroconductive elastic layer of the conductive elastic roller (conductive elastic roller after having been surface polished) 2 by using a ring coating head (discharge amount: 0.008 ml/s (speed at a ring portion: 30 mm/s, a total discharge amount: 0.064 ml)). The surface layer was formed by irradiating the coating film of the application liquid 1 on the electroconductive elastic layer with ultraviolet light having a wavelength of 254 nm so that the integrated light intensity was 8,500 mJ/cm$^2$ to cleave a glycidoxy group of the hydrolysis condensate 1 in the coating film and cross-link the cleaved product, and by leaving and drying the cross-linked product for 3 seconds. The coating film was irradiated with the ultraviolet light by using a low-pressure mercury lamp made by HARISON TOSHIBA LIGHTING CORPORATION.

As was described above, the charging roller was produced which had the support, the electroconductive elastic layer formed on the support and the surface layer formed on the electroconductive elastic layer. This charging roller is determined to be a charging roller 1.

Exemplary Embodiments 2 to 5

Charging rollers 2 to 5 were produced by the same method as in Exemplary Embodiment 1 except that the silsesquioxane No. 1 of Exemplary Embodiment 1 was changed to silsesquioxanes No. 2 to No. 5 shown in the following Table 4.

TABLE 4

| Silsesquioxane No. | |
|---|---|
| 2 | Product number: 59397-4, made by Sigma-Aldrich Japan K.K. |
| 3 | Product number: FL0583, made by Tomen Plastics Corporation |
| 4 | Product number: 47765-6, made by Sigma-Aldrich Japan K.K. |
| 5 | Product number: 56035-9 (T8), made by Sigma-Aldrich Japan K.K. |

Exemplary Embodiment 6

A charging roller 6 was produced by the same method as in Exemplary Embodiment 1 except that the silsesquioxane No. 1 of Exemplary Embodiment 1 was changed to a silsesquioxane No. 6 which was produced in the following Synthesis Example 1.

Synthesis Example 1

To a reaction container provided with a stirrer, a dripping funnel and a thermometer, 120 ml of 2-propanol (hereinafter referred to as IPA) was added as a solvent, and 9.40 g of an aqueous solution of 5% tetramethylammonium hydroxide (hereinafter referred to as TMAH aqueous solution) was added as a basic catalyst. Into the dripping funnel, 45 ml of IPA and 0.150 mol (31.56 g) of a starting material 1 represented by the following Formula (15) were charged, and the mixture was added dropwise at room temperature for 30 minutes while the reaction solution was stirred. After the addition was finished, the solution was stirred for 2 hours without being heated. After the aqueous solution was stirred for 2 hours, the solvent was removed under reduced pressure, and then 250 ml of toluene was added into the reaction container to dissolve the content therein. The toluene solution of the content was washed with saturated saline until the solution was neutralized, and then was dewatered with anhydrous magnesium sulfate. Silsesquioxane No. 6 was obtained by filtering anhydrous magnesium sulfate and concentrating the filtrate.

Formula (15)

(Starting material 1)

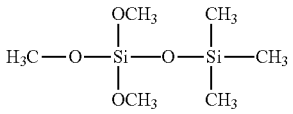

The structure and the organic substituent of the obtained silsesquioxane No. 6 was identified and the yield was calculated by using $^{29}$Si CP/MAS nuclear magnetic resonance spectrum (made by JEOL Ltd., and hereinafter referred to as $^{29}$Si—NMR), Fourier transform infrared absorption spectrum (made by JASCO Corporation, and hereinafter referred to as FT-IR), and mass spectrometry to be conducted after separation by high-performance liquid chromatography (made by SHIMADZU CORPORATION, and hereinafter referred to as LC-MS).

The signal peculiar to the basket-like structure was confirmed in the vicinity of 55 ppm by the $^{29}$Si—NMR. In addition, by the FT-IR, the peak peculiar to the Si—C bond was confirmed at 2175 cm$^{-1}$ and 770 cm$^{-1}$, and the peak peculiar to the Si—O—Si bond was confirmed at 1120 cm$^{-1}$. Furthermore, by the liquid chromatography mass spectrometry (LC-MS), it was confirmed that the base peak at mass number (m/z) 847 originated in a structure where silsesquioxane No. 6 constituted by 6 Si atoms was ionized after having lost one proton.

Furthermore, by the LC-MS, the ratio of the peak at mass number (m/z) 847 in the chromatogram to the sum of the area of the peak at mass number (m/z) 847 in the chromatogram and the area of the peak at mass number (m/z) 209 in the chromatogram, which originated from the ionized substance of the above described starting material 1, was calculated, and as a result, the value was 0.12. That is, the yield of silsesquioxane No. 6 was confirmed to be 12%.

Exemplary Embodiments 7 to 8

Silsesquioxanes No. 7 to 8 were synthesized by the same method as in Exemplary Embodiment 6 except that the starting material 1 used in Synthesis Example 1 of Exemplary Embodiment 6 was changed to a starting material 2 and a starting material 3 which were represented by the following Formulae (16) to (17), respectively. Charging rollers 7 and 8 were produced similarly to that of Exemplary Embodiment 6 by using these silsesquioxanes. Incidentally, the amount of the starting material 2 added was set at 28.55 g, and the amount of the starting material 3 added was set at 29.47 g.

Structural Formula (16)

(Starting material 2)

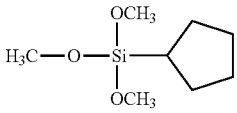

Structural Formula (17)

(Starting material 3)

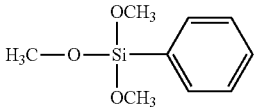

Exemplary Embodiments 9 to 12

Charging rollers 9 to 12 were produced by the same method as in Exemplary Embodiment 1 except that the silsesquioxane No. 1 of Exemplary Embodiment 1 was changed to silsesquioxanes No. 9 to 12 shown in the following Table 5.

TABLE 5

| Silsesquioxane No. | |
|---|---|
| 9 | Product number: 56038-3 (T10), made by Sigma-Aldrich Japan K.K. |
| 10 | Product number: 56035-9 (T10), made by Sigma-Aldrich Japan K.K. |
| 11 | Product number: 56038-3 (T12), made by Sigma-Aldrich Japan K.K. |
| 12 | Product number: 56035-9 (T12), made by Sigma-Aldrich Japan K.K. |

Exemplary Embodiment 13

Silsesquioxane No. 13 was synthesized by the same method as in Exemplary Embodiment 6 except that the starting material 1 used in the Synthesis Example 1 of Exemplary Embodiment 6 was changed to the starting material 4 represented by the following Formula (18). A charging roller 13 was produced similarly to that of Exemplary Embodiment 6 by using this silsesquioxane. Incidentally, the amount of the starting material 4 added was set at 20.43 g.

Formula (18)

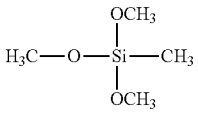

(Starting material 4)

Exemplary Embodiment 14

A charging roller 14 was produced by the same method as in Exemplary Embodiment 1 except that the silsesquioxane No. 1 of Exemplary Embodiment 1 was changed to silsesquioxane No. 14 which was obtained simultaneously when silsesquioxane No. 8 was synthesized in Exemplary Embodiment 8.

Exemplary Embodiment 15

A charging roller 15 was produced by the same method as in Exemplary Embodiment 1 except that the silsesquioxane No. 1 of Exemplary Embodiment 1 was changed to silsesquioxane No. 15 which was obtained simultaneously when silsesquioxane No. 13 was synthesized in Exemplary Embodiment 13.

Exemplary Embodiment 16

A charging roller 16 was produced by the same method as in Exemplary Embodiment 1 except that the silsesquioxane No. 1 of Exemplary Embodiment 1 was changed to silsesquioxane No. 16 which was obtained simultaneously when silsesquioxane No. 8 was synthesized in Exemplary Embodiment 8.

Exemplary Embodiment 17

13.98 g of a solution obtained by diluting the silsesquioxane No. 1 of Exemplary Embodiment 1 with MEK to 10 mass % was added so that the silsesquioxane No. 1 had 0.5 mol parts with respect to a total amount of 0.320 mol of the above described hydrolyzable silane compound added. A charging roller 17 was produced by the same method as in Exemplary Embodiment 1 except for the above operation.

Exemplary Embodiment 18

1677.34 g of a solution obtained by diluting the silsesquioxane No. 1 of Exemplary Embodiment 1 with MEK to 10 mass % was added so that the silsesquioxane No. 1 had 60 mol parts with respect to a total amount of 0.320 mol of the above described hydrolyzable silane compound added. A charging roller 18 was produced by the same method as in Exemplary Embodiment 1 except for the above operation.

The structures of silsesquioxanes No. 1 to 16 used in Exemplary Embodiments 1 to 18 are shown below. In addition, silsesquioxane used in each Exemplary Embodiment and the amount thereof added are shown in Table 6.

Silsesquioxane No. 1

(Number of Si Atoms=8, Molecular Weight=873.616)

Each of $R_{201}$ to $R_{208}$ is the group represented by the following Structural Formula (19).

Formula (19)

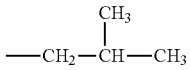

Silsesquioxane No. 2

(Number of Si Atoms=8, Molecular Weight=1883.456)

Each of $R_{201}$ to $R_{208}$ is the group represented by the following Formula (20).

Formula (20)

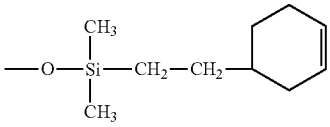

Silsesquioxane No. 3

(Number of Si Atoms=8, Molecular Weight=913.566)

$R_{201}$ to $R_{207}$ are each the group represented by the following Formula (21).

Formula (21)

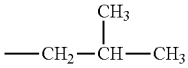

$R_{208}$ is the group represented by the following Formula (22).

$$—CH_2—CH_2—CF_3$$ Formula (22)

Silsesquioxane No. 4

(Number of Si Atoms=8, Molecular Weight=1113.796)

Each of $R_{201}$ to $R_{207}$ is the group represented by the following Formula (23).

Formula (23)

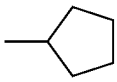

$R_{208}$ is the group represented by the following Formula (24).

Formula (24)

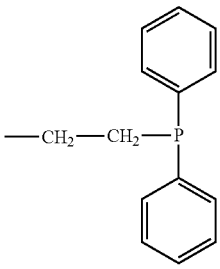

Silsesquioxane No. 5

(Number of Si Atoms=8, Molecular Weight=1257.936)

Each of $R_{101}$ to $R_{106}$ is the group represented by the following Formula (25).

Formula (25)

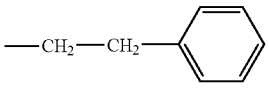

Silsesquioxane No. 6

(Number of Si Atoms=6, Molecular Weight=847.692)

Each of $R_{201}$ to $R_{208}$ is the group represented by the following Formula (26).

Formula (26)

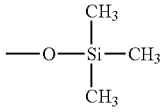

Silsesquioxane No. 7

(Number of Si Atoms=6, Molecular Weight=727.272)

Each of $R_{101}$ to $R_{106}$ is the group represented by the following Formula (27).

Formula (27)

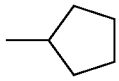

Silsesquioxane No. 8

(Number of Si Atoms=6, Molecular Weight=775.140)

Each of $R_{101}$ to $R_{105}$ is the group represented by the following Formula (28).

Formula (28)

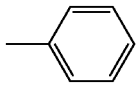

Silsesquioxane No. 9

(Number of Si Atoms=10, Molecular Weight=1653.060)

Each of $R_{301}$ to $R_{310}$ is the group represented by the following Formula (29).

Formula (29)

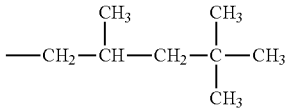

Silsesquioxane No. 10

(Number of Si Atoms=10, Molecular Weight=1572.420)

Each of $R_{301}$ to $R_{310}$ is the group represented by the following Formula (30).

Formula (30)

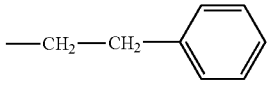

Silsesquioxane No. 11

(Number of Si Atoms=12, Molecular Weight=1983.672)

Each of $R_{401}$ to $R_{412}$ is the group represented by the following Formula (31).

Formula (31)

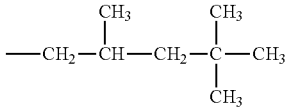

Silsesquioxane No. 12

(Number of Si Atoms=12, Molecular Weight=1886.904)

Each of $R_{401}$ to $R_{412}$ is the group represented by the following Formula (32).

Formula (32)

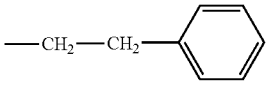

Silsesquioxane No. 13

(Number of Si Atoms=14, Molecular Weight=939.736)

Each of $R_{501}$ to $R_{514}$ is a methyl group.

Silsesquioxane No. 14

(Number of Si Atoms=14, Molecular Weight=1808.660)

Each of $R_{501}$ to $R_{514}$ is a phenyl group.

Silsesquioxane No. 15

(Number of Si Atoms=16, Molecular Weight=1073.984)

Each of $R_{601}$ to $R_{616}$ is a methyl group.

Silsesquioxane No. 16

(Number of Si Atoms=16, Molecular Weight=2067.040)

Each of $R_{601}$ to $R_{616}$ is a phenyl group.

TABLE 6

| Exemplary embodiment | Silsesquioxane No. | Amount added (g) |
|---|---|---|
| 1 | 1 | 279.56 |
| 2 | 2 | 602.71 |
| 3 | 3 | 292.34 |
| 4 | 4 | 356.41 |
| 5 | 5 | 402.54 |
| 6 | 6 | 271.26 |
| 7 | 7 | 232.73 |
| 8 | 8 | 248.04 |
| 9 | 9 | 528.98 |
| 10 | 10 | 503.17 |
| 11 | 11 | 634.78 |
| 12 | 12 | 603.81 |
| 13 | 13 | 300.72 |
| 14 | 14 | 578.77 |
| 15 | 15 | 343.67 |
| 16 | 16 | 661.45 |
| 17 | 1 | 13.98 |
| 18 | 1 | 1677.34 |

Comparative Example 1

A solution C1 which contained a condensate of the hydrolyzable silane compound was obtained by mixing the raw materials shown in the following Table 7, stirring the mixture at room temperature, and heating the stirred mixture under reflux for 24 hours (100° C.) After that, a charging roller C1 was obtained similarly to Exemplary Embodiment 1 except that the surface layer was formed by thermal-curing the condensate C1 at 160° C. for 1 hour, and the physical properties were measured.

TABLE 7

| | |
|---|---|
| Phenyltriethoxysilane (PhTES) | 56.25 g (0.234 mol) |
| Hexyltrimethoxysilane (HeTMS) | 13.21 g (0.064 mol) |
| Tridecafluoro-1,1,2,2-tetrahydro octyltriethoxysilane (FTS, number of carbon atoms in perfluoroalkyl group = 6) | 11.23 g (0.022 mol) |
| Water | 25.93 g |
| Ethanol | 61.50 g |

Comparative Example 2

A charging roller C2 was obtained similarly to Exemplary Embodiment 1 except that 0.5 parts by mass of a silica filler (trade name: ADMAFINE made by Admatechs Company Limited, mean particle size=1.0 specific surface area=3.6 $m^2/g$) to the condensate-containing solution C1 used in Comparative Example 1, and the physical properties were measured.

Measurement of Physical Properties of Charging Roller

The physical properties of the charging roller of the above described Exemplary Embodiments and Comparative Examples were measured with the method described below.

(1) Modulus of Elasticity of Surface Layer;

The modulus of the elasticity of the surface layer of a charging roller was measured by using a surface-film physical-property testing instrument (trade name: "FISCHERSCOPE H100V", made by Fischer Instruments K.K.). The modulus of elasticity was determined to be the value measured when the indenter was made to ingress into the surface of a measuring object at a speed of 1 μm/7 sec. In addition, the sample used for measuring the modulus of elasticity was prepared by applying the above described application solution for the surface layer onto the aluminum sheet so that the thickness of the film which was cured was 10 μm or thicker, and UV-curing or thermal-curing the wet film on the same conditions as those for the charging roller in the above described Exemplary Embodiment or Comparative Example. The results are shown in Table 8.

(2) Layer Thickness of Surface Layer;

The layer thickness of the surface layer of a charging roller was measured by collecting a portion in the vicinity of the surface layer of the charging roller from the base layer as a sample piece, vapor-depositing platinum on the sample piece from the cross section side of the surface layer, then mounting the sample piece in the scanning electron microscope (trade name: "S-4800", made by Hitachi High-Technologies Corporation), and observing the cross section. The obtained results were shown in Table 8.

(3) Ten Point Height of Irregularities of Surface Layer;

The ten point height of irregularities (Rzjis) of the surface layer of a charging roller was measured in conformity with JIS B 0601:2001. The obtained results were shown in Table 8.

TABLE 8

| | Modulus of elasticity MPa | Layer thickness nm | Rzjis μm |
|---|---|---|---|
| Exemplary embodiment 1 | 3251 | 51 | 5.2 |
| Exemplary embodiment 2 | 4101 | 45 | 6.8 |
| Exemplary embodiment 3 | 3684 | 36 | 4.9 |
| Exemplary embodiment 4 | 2648 | 44 | 6.1 |
| Exemplary embodiment 5 | 2461 | 41 | 5.9 |
| Exemplary embodiment 6 | 2105 | 29 | 5.2 |
| Exemplary embodiment 7 | 3549 | 48 | 5.3 |
| Exemplary embodiment 8 | 3204 | 35 | 4.9 |
| Exemplary embodiment 9 | 2200 | 32 | 4.1 |
| Exemplary embodiment 10 | 2032 | 33 | 6.4 |
| Exemplary embodiment 11 | 3002 | 28 | 5.9 |
| Exemplary embodiment 12 | 3140 | 50 | 6.2 |
| Exemplary embodiment 13 | 2047 | 45 | 6.8 |
| Exemplary embodiment 14 | 2004 | 46 | 3.8 |
| Exemplary embodiment 15 | 3064 | 37 | 4.2 |
| Exemplary embodiment 16 | 3120 | 38 | 3.9 |
| Exemplary embodiment 17 | 2008 | 39 | 4.8 |
| Exemplary embodiment 18 | 4059 | 46 | 5.6 |
| Comparative Example 1 | 405 | 25 | 4.6 |
| Comparative Example 2 | 1520 | 1,052 | 9.7 |

(4) Content of Functional Group in Polysiloxane;

While using a three-dimensional rough and slight adjustment micromanipulator (made by Narishige Co., Ltd.) installed in an optical microscope with a magnification of 10 to 1,000 times, approximately 1 mg of a sample was collected from the surface layer of a charging roller under the optical microscope. The collected sample was subjected to thermogravimetry-mass spectrometry (TG-MS method; (MS apparatus is directly connected to TG apparatus)), and the change in concentration in each mass number of gases generated during heating was traced simultaneously with the change in weight as a function of a temperature. The measuring condition is shown in Table 9.

TABLE 9

| | | | |
|---|---|---|---|
| Apparatuses | TG-MS Apparatuses | TG Apparatuses | SHIMADZU CORPORATION TG-40 type |
| | | MS Apparatuses | SHIMADZU CORPORATION |
| Measurement conditions | Start of measurement | After a sample has been set in the TG apparatus, a carrier gas is passed for 15 minutes or longer, and temperature rise is started. | |
| | Heating condition | Room temperature to 1,000° C. (rate of temperature rise 20° C./min) | |
| MS sensitivity | gain 3.5 | | |
| Mass number range | m/z = 10-300 | | |
| | In m/z, m represents a mass number and z represents the valence of an ion. Because the valence of an ion is usually 1, m/z corresponds to the mass number. | | |
| Atmosphere | Helium (He) flow (30 ml/min) | | |

According to the result of the simultaneous measurement of a differential thermal analysis thermogravimetric analysis (TG-DTA) obtained by the measurement on the above described conditions, two stages of remarkable weight loss were found in the vicinity of 400 to 500° C. and in the vicinity of 500 to 650° C. Here, the peaks shown in the following Table 10 were confirmed about the gases generated at 400 to 500° C.

TABLE 10

| | |
|---|---|
| Mass numbers (m/z) 31, 43, 58, 59 | Peak originating from oxyalkylene group (originating from glycidoxy group of glycidoxypropyltriethoxysilane) |
| Mass numbers (m/z) 78 (benzene), 91 (toluene) and the like | Peak originating from aryl group |
| Mass numbers (m/z) 16, 41 and the like | Peak originating from alkyl group |

From the above described peaks, the concentrations of the gas components, which originated from each of the above described groups, that were generated from the polysiloxane degraded at the above described temperatures of 400 to 500° C. were determined. In addition, the rates of weight losses due to the gas components, which originated from each of the above described groups, that were generated at each temperature were determined from the concentrations of the gas components which originated from each of the groups and the measured rates of the weight losses. The rates of the weight losses were integrated over the above described 400° C. to 500° C., and the content of each of the oxyalkylene group, the aryl group and the alkyl group in the polysiloxane was determined.

In addition, from gases generated at 500° C. to 650° C., the peaks were confirmed which originated from alkyl fluoride groups having mass number (m/z) 51, 69, 119 and 131 (originating from alkyl fluoride groups of tridecafluoro-1,1,2,2, tetrahydrooctyl triethoxysilane, or originating from substituents of silsesquioxane).

From these peaks, the concentrations of the gas components, which originated from the alkyl fluoride groups, that were generated from the polysiloxane degraded at the above described temperatures of 500° C. to 650° C. were determined. In addition, the rates of weight losses due to the gas components, which originated from the alkyl fluoride groups, that were generated at the temperatures were determined from the concentrations of the gas components originating from the alkyl fluoride groups and the measured rates of weight losses. The rates of the weight losses were integrated over the above described temperature of 500° C. to 600° C., and the content of the alkyl fluoride groups in the polysiloxane was determined. For information, the residue after heating was assumed to be siloxane moieties originating from the first unit, the second unit, the third unit or silsesquioxane.

(5) The Ratio of the Various Substituents which Polysiloxane in the Surface Layer has, and Content of the Basket-Like Structure Originating from Silsesquioxane;

While using a three-dimensional electrically-driven micromanipulator (Three-axis motorized micromanipulator) (trade name: EMM-3NV; made by Narishige Co., Ltd.) installed in an optical microscope with a magnification of 10 to 1,000 times, approximately 300 mg of a sample was collected from the surface layer of a charging roller, under the optical microscope. The collected sample was subjected to measurement by solid $^{29}$Si CP/MAS nuclear magnetic resonance spectrum (made by JEOL Ltd., hereinafter referred to as solid $^{29}$Si—NMR). As a result, the peaks shown in the following Table 11 were confirmed.

TABLE 11

| | |
|---|---|
| −55, −65, −90--100 ppm | Peak peculiar to basket-like structure of silsesquioxane |
| −49, −61, −62 ppm | Peak originating from first unit |
| −56, −57, −70, −72 ppm | Peak originating from second unit |
| −66, −79, −80 ppm | Peak originating from third unit |

The basket-like structure refers to a skeletal part having a siloxane bond except a substituent, in the structures shown in the compounds (1) to (6). In solid $^{29}$Si—NMR, the peak in the vicinity of −55 ppm originates from a basket-like structure having 6 Si atoms, in many cases. The peak in the vicinity of −65 ppm originates from a basket-like structure having 8 Si atoms, in many cases. In addition, the peak in the vicinity of −90 to −100 ppm originates from a basket-like structure having 10 to 16 Si atoms, in many cases. For this reason, the area of the peaks in each of the above described −55, −65, −90 to −100 ppm, which originate from the basket-like structures of silsesquioxane, were determined to the mol numbers of the Si atoms constituting the basket-like structures of silsesquioxane.

Then, the value was determined to be the mol number of silsesquioxane, which was obtained by dividing the peak area that was determined to be the mol number of Si atoms by the number of Si atoms constituting the basket-like structure of silsesquioxane having the corresponding specific structure. The value was determined to be the mol % of the basket-like structure contained in the surface layer, which was obtained by dividing the peak area converted into the mol number of the silsesquioxane by the sum total of the peak areas originating from the first unit, the second unit and the third unit.

Furthermore, the value was determined to be the mol % (x) of the first unit, which was obtained by dividing the area % of the peaks at −49, −61 and −62 ppm that originated from the first unit of polysiloxane in the present invention, by the sum total of the peak areas originating in the first to the third unit, respectively. Similarly, the mol % of the second unit (y) and the mol % of the third unit (z) were calculated. Subsequently, the value of (x+y)/(x+y+z) was calculated.

Table 12 shows the mass % of the oxyalkylene group, the aryl group, the alkyl group, the alkyl fluoride group and the siloxane moiety, which were obtained by the measurement of the above described (4) and (5), and (x+y)/(x+y+z), and the content of the basket-like structure originating from silsesquioxane.

Evaluation of a Charging Roller

The following evaluations were conducted by using charging rollers 1 to 18 according to the above described Exemplary Embodiments and charging rollers C1 and C2 according to the Comparative Examples. Firstly, each charging roller and electrophotographic photosensitive member were integrated in a process cartridge (trade name: "EP-85 (black)", made by Canon Inc.) which integrally supports the charging roller and the electrophotographic photosensitive member therein. Subsequently, the process cartridge was mounted in the laser beam printer (trade name: "LBP-5500", made by Canon Inc.), for longitudinally outputting an A4 paper. The developing method of this laser beam printer is a reversal developing method, the output speed of a transfer material is 47 mm/s, and the image resolution is 600 dpi.

In addition, the electrophotographic photosensitive member integrated in the process cartridge together with the charging roller is an organic electrophotographic photosensitive member having an organic photosensitive layer with a layer thickness of 14 μm formed on the support. In addition, this organic photosensitive layer is a stacked-type photosensitive layer in which an electric-charge-generating layer and an electric-charge-transporting layer containing a modified polyarylate (binding resin) are stacked from the support side, and

TABLE 12

| | TG-MS | | | | | 29Si-NMR | |
|---|---|---|---|---|---|---|---|
| | Oxyalkylene group mass % | Aryl group mass % | Alkyl group mass % | Alkyl fluoride group mass % | Siloxane moiety mass % | (x + y)/(x + y + z) | Basket-like structure mol % |
| Exemplary embodiment 1 | 21 | 8 | 22 | 6 | 43 | 0.60 | 10.1 |
| Exemplary embodiment 2 | 19 | 6 | 22 | 11 | 42 | 0.65 | 8.5 |
| Exemplary embodiment 3 | 18 | 8 | 26 | 14 | 34 | 0.62 | 9.2 |
| Exemplary embodiment 4 | 17 | 12 | 24 | 8 | 39 | 0.67 | 11.1 |
| Exemplary embodiment 5 | 16 | 9 | 23 | 12 | 40 | 0.71 | 14.3 |
| Exemplary embodiment 6 | 15 | 8 | 23 | 7 | 47 | 0.68 | 10.1 |
| Exemplary embodiment 7 | 12 | 6 | 24 | 9 | 49 | 0.69 | 11.0 |
| Exemplary embodiment 8 | 13 | 14 | 20 | 11 | 42 | 0.70 | 6.4 |
| Exemplary embodiment 9 | 14 | 9 | 24 | 10 | 43 | 0.59 | 8.4 |
| Exemplary embodiment 10 | 16 | 8 | 21 | 11 | 44 | 0.61 | 8.2 |
| Exemplary embodiment 11 | 14 | 8 | 28 | 6 | 44 | 0.79 | 10.1 |
| Exemplary embodiment 12 | 13 | 9 | 26 | 4 | 48 | 0.81 | 12.6 |
| Exemplary embodiment 13 | 11 | 6 | 21 | 5 | 57 | 0.64 | 14.1 |
| Exemplary embodiment 14 | 11 | 13 | 19 | 8 | 49 | 0.66 | 8.8 |
| Exemplary embodiment 15 | 16 | 9 | 21 | 9 | 45 | 0.80 | 10.0 |
| Exemplary embodiment 16 | 12 | 13 | 22 | 11 | 42 | 0.82 | 9.1 |
| Exemplary embodiment 17 | 16 | 9 | 26 | 11 | 38 | 0.70 | 0.5 |
| Exemplary embodiment 18 | 12 | 8 | 11 | 10 | 59 | 0.79 | 62.5 |
| Comparative Example 1 | 0 | 11 | 35 | 13 | 41 | 0.71 | — |
| Comparative Example 2 | 0 | 8 | 22 | 12 | 58 | 0.60 | — |

this electric-charge-transporting layer is the surface layer of the electrophotographic photosensitive member. Furthermore, a toner used for the above described laser beam printer is a so-called polymerized toner which contains particles obtained by suspending and polymerizing a polymerizable monomer system containing wax, an electric-charge-controlling agent, pigment, styrene, butyl acrylate and an ester monomer, in an aqueous medium. This toner is a polymerized toner containing a toner particle which is prepared by externally adding silica particulates and titanium oxide particulates to the above described particles, and has a glass transition temperature of 63° C. and a volume mean particle size of 6 μm. The image was output under the environment of 30° C./80% RH, an E character pattern with a print rate of 4% was formed on the A4 paper, and 6,000 sheets of the paper were output at a process speed of 47 mm/s.

(1) Wear Resistance of Surface Layer;

As an index of the wear resistance of the surface layer in each charging roller, a ratio of the layer thickness (nm) of the surface layer after 6,000 sheets were output to the layer thickness (nm) of the surface layer in the early stage was calculated as retention. It was determined that the smaller the retention is, the more the layer is worn. The layer thickness of the surface layer was measured with the above described method, and the values were compared.

(2) Image Evaluation;

The presence or absence of a streak was observed which appeared on an electrophotographic image when the charge unevenness occurred due to the wear of the surface layer of a charging member. An image used for observation was an image (halftone image) for drawing a horizontal line having a width of 1 dot and a space of 2 dots in the perpendicular direction to the rotation direction of the electrophotographic photosensitive member on an A4 paper. The image was evaluated by visually observing output images obtained when every 1,000 sheets from the first sheet (in the early stage) to the 6,000th sheet were output.

The criteria for evaluation are described below:

1: No longitudinal streak occurred.

2: An extremely small amount of longitudinal streaks occurred.

3: A large amount of longitudinal streaks occurred.

The following Table 13 shows the results of the above described evaluation for the wear resistance and the image evaluation on the surface layer.

TABLE 13

| | (i) Wear resistance | | | (ii) Image evaluation | | | | | | |
|---|---|---|---|---|---|---|---|---|---|---|
| | Initial | After 6,000 sheets | Retention | Initial | 1000 sheets | 2000 sheets | 3000 sheets | 4000 sheets | 5000 sheets | 6000 sheets |
| Exemplary embodiment 1 | 51 | 50 | 98% | 1 | 1 | 1 | 1 | 1 | 1 | 1 |
| Exemplary embodiment 2 | 45 | 44 | 97% | 1 | 1 | 1 | 1 | 1 | 1 | 1 |
| Exemplary embodiment 3 | 36 | 35 | 98% | 1 | 1 | 1 | 1 | 1 | 1 | 2 |
| Exemplary embodiment 4 | 44 | 43 | 98% | 1 | 1 | 1 | 1 | 1 | 2 | 2 |
| Exemplary embodiment 5 | 41 | 38 | 93% | 1 | 1 | 1 | 1 | 2 | 2 | 2 |
| Exemplary embodiment 6 | 29 | 28 | 98% | 1 | 1 | 1 | 1 | 1 | 1 | 1 |
| Exemplary embodiment 7 | 48 | 44 | 92% | 1 | 1 | 1 | 1 | 2 | 2 | 2 |
| Exemplary embodiment 8 | 35 | 32 | 92% | 1 | 1 | 1 | 1 | 2 | 2 | 2 |
| Exemplary embodiment 9 | 32 | 27 | 85% | 1 | 1 | 1 | 1 | 1 | 1 | 2 |
| Exemplary embodiment 10 | 33 | 28 | 86% | 1 | 1 | 1 | 2 | 2 | 2 | 2 |
| Exemplary embodiment 11 | 28 | 24 | 86% | 1 | 1 | 1 | 1 | 1 | 1 | 2 |
| Exemplary embodiment 12 | 50 | 42 | 84% | 1 | 1 | 1 | 2 | 2 | 2 | 2 |
| Exemplary embodiment 13 | 45 | 37 | 82% | 1 | 1 | 1 | 1 | 1 | 2 | 2 |
| Exemplary embodiment 14 | 46 | 39 | 84% | 1 | 1 | 1 | 2 | 2 | 2 | 2 |
| Exemplary embodiment 15 | 37 | 30 | 81% | 1 | 1 | 1 | 1 | 1 | 2 | 2 |
| Exemplary embodiment 16 | 38 | 30 | 79% | 1 | 1 | 2 | 2 | 2 | 2 | 2 |
| Exemplary embodiment 17 | 39 | 35 | 90% | 1 | 1 | 1 | 1 | 2 | 2 | 2 |
| Exemplary embodiment 18 | 46 | 43 | 93% | 1 | 1 | 1 | 1 | 1 | 2 | 2 |
| Comparative Example 1 | 25 | 14 | 54% | 1 | 2 | 2 | 2 | 2 | 3 | 3 |
| Comparative Example 2 | 1,052 | 228 | 22% | 1 | 2 | 3 | 3 | 3 | 3 | 3 |

As shown in Table 13, it is understood that the charging member in the present invention has a surface layer which is resistant to wear even by the repeated use and is resistant to change in the charging performance even by the use.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-282694, filed Dec. 14, 2009, which is hereby incorporated by reference herein in its entirety.

What is claimed is:

1. A charging member comprising:

a support, an electroconductive elastic layer and a surface layer in this order, wherein said surface layer comprises polysiloxane and silsesquioxane, wherein said polysiloxane has a first unit represented by $SiO_{0.5}R^1(OR^2)(OR^3)$, a second unit represented by $SiO_{1.0}R^4(OR^5)$ and a third unit represented by $SiO_{1.5}R^6$, and said silsesquioxane is at least one compound selected from the group consisting of compounds represented by the following compounds (1) to (6):

Compound (1)

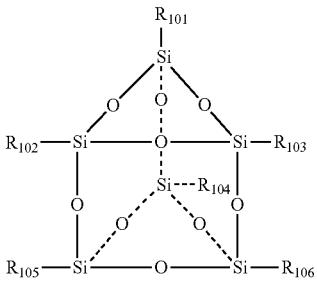

Compound (2)

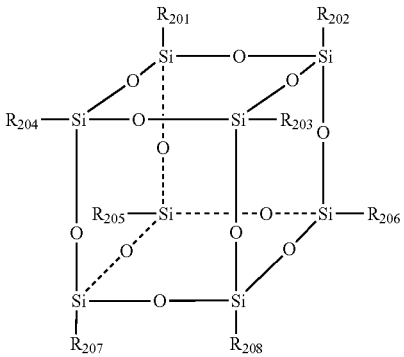

-continued

Compound (3)

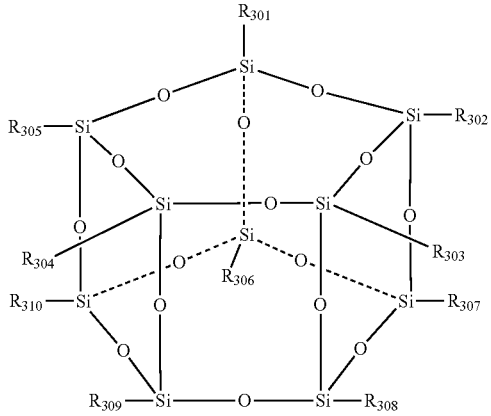

Compound (4)

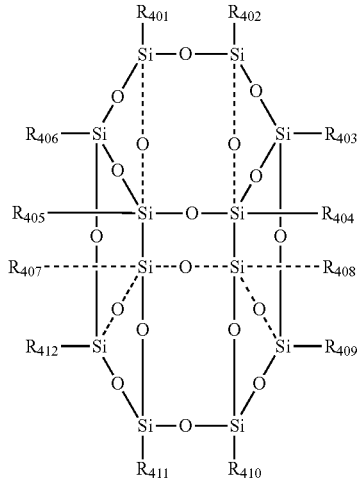

Compound (5)

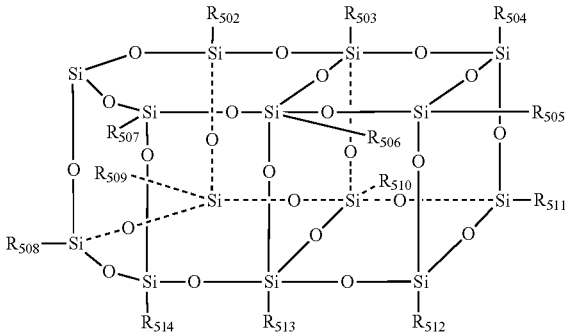

Compound (6)

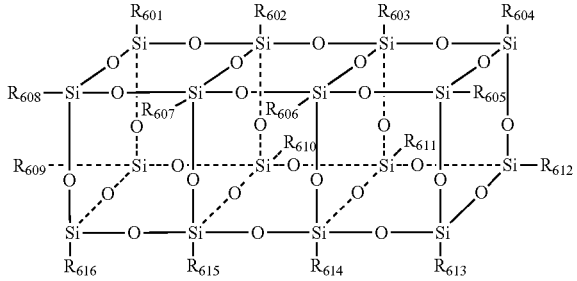

wherein $R^1$, $R^4$ and $R^6$ each independently represent a substituted or unsubstituted alkyl group, or a substituted or unsubstituted aryl group; $R^2$, $R^3$ and $R^5$ each independently represent a hydrogen atom or a substituted or unsubstituted alkyl group; $R_{101}$ to $R_{616}$ in the compounds (1) to (6) are each independently at least one selected from the group consisting of a substituted or unsubstituted alkyl group, a substituted or unsubstituted aryl group, and a group represented by the following Formula (7):

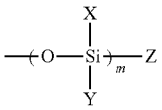

(7)

wherein X, Y and Z are each independently at least one selected from the group consisting of a substituted or unsubstituted alkyl group and a substituted or unsubstituted aryl group; and m is an integer of 1 to 20.

2. The charging member according to claim 1, wherein $R_{101}$ to $R_{616}$ in the compounds (1) to (6) are each independently any one selected from the group consisting of an unsubstituted alkyl group having 1 to 20 carbon atoms and a group represented by the Formula (7), and when any substituent selected from $R_{101}$ to $R_{616}$ is the Formula (7), X and Y in the Formula (7) are each an alkyl group having 1 to 3 carbon atoms, Z is an alkyl group having 1 to 3 carbon atoms or a cycloalkenyl-modified alkyl group, and m is 1.

3. The charging member according to claim 2, wherein the silsesquioxane is a silsesquioxane represented by the compound (2), $R_{201}$ to $R_{208}$ are any one selected from the group consisting of a branched alkyl group having 1 to 20 carbon atoms and a group represented by the Formula (7), and all of $R_{201}$ to $R_{208}$ are the same group.

4. An electrophotographic apparatus comprising a charging member according to claim 1, and an electrophotographic photosensitive member which is arranged so as to come into contact with the charging member.

5. A process cartridge which integrally holds a charging member according to claim 1 and at least one member selected from the group consisting of an electrophotographic photosensitive member, a developing unit, a transfer unit and a cleaning unit, and is adapted so as to be detachably mounted on a main body of an electrophotographic apparatus.

* * * * *